US010844637B2

(12) United States Patent
Yalamati et al.

(10) Patent No.: US 10,844,637 B2
(45) Date of Patent: Nov. 24, 2020

(54) QUIET LATCH FOR A LOCKING DEVICE

(71) Applicant: Schlage Lock Company LLC, Carmel, IN (US)

(72) Inventors: Bhargav Yalamati, Hyderabad (IN); Chetan V, Bangalore (IN); Sachin Chandra Shetty, Bangalore (IN); Prabhat Kumar Yadav, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 907 days.

(21) Appl. No.: 15/363,180

(22) Filed: Nov. 29, 2016

(65) Prior Publication Data

US 2018/0148955 A1 May 31, 2018

(51) Int. Cl.
*E05B 65/10* (2006.01)
*E05B 17/00* (2006.01)
(Continued)

(52) U.S. Cl.
CPC ..... *E05B 65/1046* (2013.01); *E05B 17/0041* (2013.01); *E05B 65/1053* (2013.01); *E05B 65/1086* (2013.01); *E05C 19/02* (2013.01); *E05C 21/00* (2013.01); *E05B 17/002* (2013.01); *E05B 17/0045* (2013.01);
(Continued)

(58) Field of Classification Search
CPC ..... E05B 65/1046; E05B 17/0041; E05B 65/1053; E05B 65/1086; E05B 77/42; E05B 17/0045; E05C 19/02; E05C 21/00; Y10T 292/0871; Y10T 292/0908
See application file for complete search history.

(56) References Cited

U.S. PATENT DOCUMENTS 2,006,922 A 7/1935 Jacobi
2,098,776 A 11/1937 Edwards
(Continued)

OTHER PUBLICATIONS

International Search Report; International Searching Authority; International Patent Application No. PCT/US2017/063606; dated Feb. 2, 2018; 2 pages.
(Continued)

*Primary Examiner* — Carlos Lugo
*Assistant Examiner* — Faria F Ahmad
(74) *Attorney, Agent, or Firm* — Taft Stettinius & Hollister LLP

(57) ABSTRACT

A locking device for a door located at a door frame having a door strike. The locking device includes an actuator having a neutral position and a displaced position, and a latchbolt assembly having an extended position configured to engage the door strike, and a retracted position configured to move past the door strike. The latchbolt assembly includes a latchbolt link configured to move the latchbolt in response to movement of the actuator. A first dampening device is disposed adjacent to the latchbolt link, with the dampening device resiliently engaging the latchbolt link as the latchbolt link moves from the retracted position to the extended position. The first dampening device limits movement of the latchbolt link. A second dampening device is configured to restrain movement of the latchbolt during movement from the retracted position to the extended position.

21 Claims, 7 Drawing Sheets

(51) Int. Cl.

| | |
|---|---|
| ***E05C 19/02*** | (2006.01) |
| ***E05C 21/00*** | (2006.01) |
| ***E05B 77/42*** | (2014.01) |
| ***E05B 17/20*** | (2006.01) |

(52) U.S. Cl.
CPC ..... *E05B 17/2084* (2013.01); *E05B 77/42* (2013.01); *Y10T 292/0871* (2015.04); *Y10T 292/0908* (2015.04); *Y10T 292/0909* (2015.04)

(56) References Cited

U.S. PATENT DOCUMENTS

| | | | | | |
|---|---|---|---|---|---|
| 4,145,900 | A * | 3/1979 | Ohno | E05B 65/104 | 292/92 |
| 4,167,280 | A * | 9/1979 | Godec | E05B 65/1053 | 292/21 |
| 4,181,335 | A * | 1/1980 | Thoren | E05B 1/0053 | 292/166 |
| 4,872,716 | A | 10/1989 | Legrand et al. | | |
| 5,011,199 | A | 4/1991 | Lowe et al. | | |
| 5,067,757 | A * | 11/1991 | Cohrs | E05B 17/0041 | 292/336.3 |
| 5,085,475 | A * | 2/1992 | Austin | E05B 65/1093 | 292/144 |
| 5,129,879 | A | 7/1992 | Mattson | | |
| 6,769,723 | B2 * | 8/2004 | Cohrs, Jr. | E05B 65/1053 | 292/92 |
| 6,820,905 | B1 | 11/2004 | Haeck et al. | | |
| 8,495,836 | B2 | 7/2013 | Lowder et al. | | |
| 10,030,411 | B2 * | 7/2018 | Coleman | E05B 65/1053 | |
| 2003/0090113 | A1 | 5/2003 | Piorkowski et al. | | |
| 2004/0041412 | A1 | 3/2004 | Cohrs, Jr. et al. | | |
| 2009/0031528 | A1 | 2/2009 | Zimmer et al. | | |
| 2010/0026012 | A1 * | 2/2010 | Lin | E05B 65/1053 | 292/92 |
| 2010/0045053 | A1 * | 2/2010 | Dye | E05B 47/0012 | 292/201 |
| 2012/0032455 | A1 | 2/2012 | Lin | | |
| 2016/0115719 | A1 * | 4/2016 | Coleman | E05B 17/2084 | 292/195 |
| 2016/0230423 | A1 | 8/2016 | Lehner, Jr. et al. | | |
| 2016/0333621 | A1 | 11/2016 | Lehner, Jr. et al. | | |
| 2018/0128015 | A1 * | 5/2018 | Shah | E05B 17/0045 | |

OTHER PUBLICATIONS

International Written Opinion; International Searching Authority; International Patent Application No. PCT/US2017/063606; dated Feb. 2, 2018; 8 pages.

* cited by examiner

QUIET LATCH FOR A LOCKING DEVICE

TECHNICAL FIELD

The present invention generally relates to locking devices, and more particularly but not exclusively to pushbar-type locking devices.

BACKGROUND

Commercial or public buildings are typically required by law to provide for an emergency exit in case of an adverse event such as a fire. Common emergency exits include a latch closed double door where both doors are mounted within a door frame, and a latch closed single door mounted in a door frame. An exit device mounted to the door is typically used by individuals to exit the building through the emergency exit. Different types of exit devices include panic bars, push pads, and pushbars. A pushbar is commonly located on a door at a convenient height for an individual to push when exiting through the door. Depressing the pushbar actuates retraction of a latchbolt, thereby allowing the door to be opened.

Even though the pushbar exit device provides certain advantages for individuals exiting a building or moving from one area to another area within a building, the pushbar exit device can often produce unwanted or undesired noise. This noise results from the operation of hardware located within the device and the pushbar latch contacting a door strike. In some environments, the noise is tolerable or even unnoticed such as, for instance, when pushbar exit devices are used in a sports facility. However, when the same pushbar exit device is located in a healthcare environment such as, for example, in a hospital, the noise produced by the pushbar exit device and latch is undesirable and can even be intolerable. For example, noise from the pushbar exit device can disturb a patient's sleep, which can in turn interfere with wound healing and pain management. Other environments where noise generated by a pushbar exit device is unwanted or undesirable include schools, libraries, office space, and other generally quiet environments.

Other types of locking devices used at a door include mortise locks, cylindrical locks, tubular locks, and remote latching devices used with either single or multiple exit doors and devices. Each of these locking devices includes moving mechanical components which can create undesirable or unwanted noise when actuated.

What is therefore needed is a locking device, and in some embodiments a pushbar exit device, having a reduced noise profile to reduce or minimize the level of noise produced by the locking device upon opening and closing of the door.

SUMMARY

A quiet pushbar exit device provides a quiet environment in hospitals and other buildings such as libraries, schools and office space. Current exit doors, including corridor doors, main doors, and room doors in these buildings generate or produce noise when shut either manually or automatically by an associated door closer. One contributing factor in generation of the noise results from a latchbolt hitting a door strike, and then being released after the latchbolt clears the door strike. Embodiments of the present disclosure reduce noise when door is closed, thereby facilitating a quiet environment. Healthcare facilities in particular benefit from embodiments of the present disclosure as a quiet environment in patient wards or rooms has become an appropriate parameter for measuring patient satisfaction. The level of noise within a healthcare facility can also present financial implications to the hospital.

In one embodiment, there is provided a locking device for a door located at a door frame having a door strike. The locking device includes a latchbolt assembly having an extended position configured to engage the door strike, and a retracted position configured to move past the door strike. An actuator is adapted to move the latchbolt assembly from the extended position to the retracted position. A dampening device is disposed adjacent to the latchbolt assembly, wherein the dampening device resiliently engages the latchbolt assembly as the latchbolt assembly moves from the retracted position to the extended position.

In another embodiment, there is provided an exit device for a door located at a door frame having a door strike including a pushbar having a released position and a depressed position, wherein the pushbar defines a longitudinal axis. A latchbolt assembly is disposed along the longitudinal axis and includes an extended position configured to engage the door strike, and a retracted position configured to move past the door strike, wherein movement of the pushbar from the released position to the depressed position moves the latchbolt assembly from the extended position to the retracted position. A first bell crank mechanism is operatively connected to the pushbar and is disposed along the longitudinal axis at a first location. A second bell crank mechanism is operatively connected to the pushbar and is disposed along the longitudinal axis at a second location, wherein the first bell crank mechanism is located between the latchbolt assembly and the second bell crank mechanism. A dampening device is disposed along the longitudinal axis between the latchbolt assembly and the first bellcrank assembly, wherein the dampening device is configured to restrain movement of the latchbolt assembly during movement from the retracted position to the extended position.

In still another embodiment, there is provided an exit device for a door located at a door frame having a door strike. The exit device includes a pushbar having a released position and a depressed position wherein the pushbar defines a longitudinal axis. A latchbolt assembly is disposed along the longitudinal axis and includes an extended position configured to engage the door strike and a retracted position configured to move past the door strike, wherein movement of the pushbar from the released position to the depressed position moves the latchbolt assembly from the extended position to the retracted position. A first bell crank mechanism is operatively connected to the pushbar and is disposed along the longitudinal axis at a first location. A second bell crank mechanism is operatively connected to the pushbar and is disposed along the longitudinal axis at a second location, wherein the first bell crank mechanism is located between the latchbolt assembly and the second bell crank mechanism. A first dampening device is disposed adjacent to the latchbolt assembly, wherein the dampening device resiliently engages the latchbolt assembly as the latchbolt moves from the retracted position to the extended position. A second dampening device is disposed along the longitudinal axis between the latchbolt assembly and the first bellcrank assembly, wherein the second dampening device is configured to restrain movement of the latchbolt assembly during movement from the retracted position to the extended position.

In a further embodiment, there is provide a method for reducing noise produced by a pushbar exit device including a pushbar, a latchbolt having an extended position and a retracted position, and a latchbolt link operatively connected to the pushbar and configured to move the latchbolt from the extended position to the retracted position and back to the extended position. The method includes locating the latchbolt link at a first position to place the latchbolt at the extended position, moving the latchbolt link from the first position to a second position to place the latchbolt at the retracted position, and limiting movement of the latchbolt link from the second position to the first position when the latchbolt moves from the retracted position to the extended position.

DETAILED DESCRIPTION OF ILLUSTRATIVE EMBODIMENTS

Figure 1:
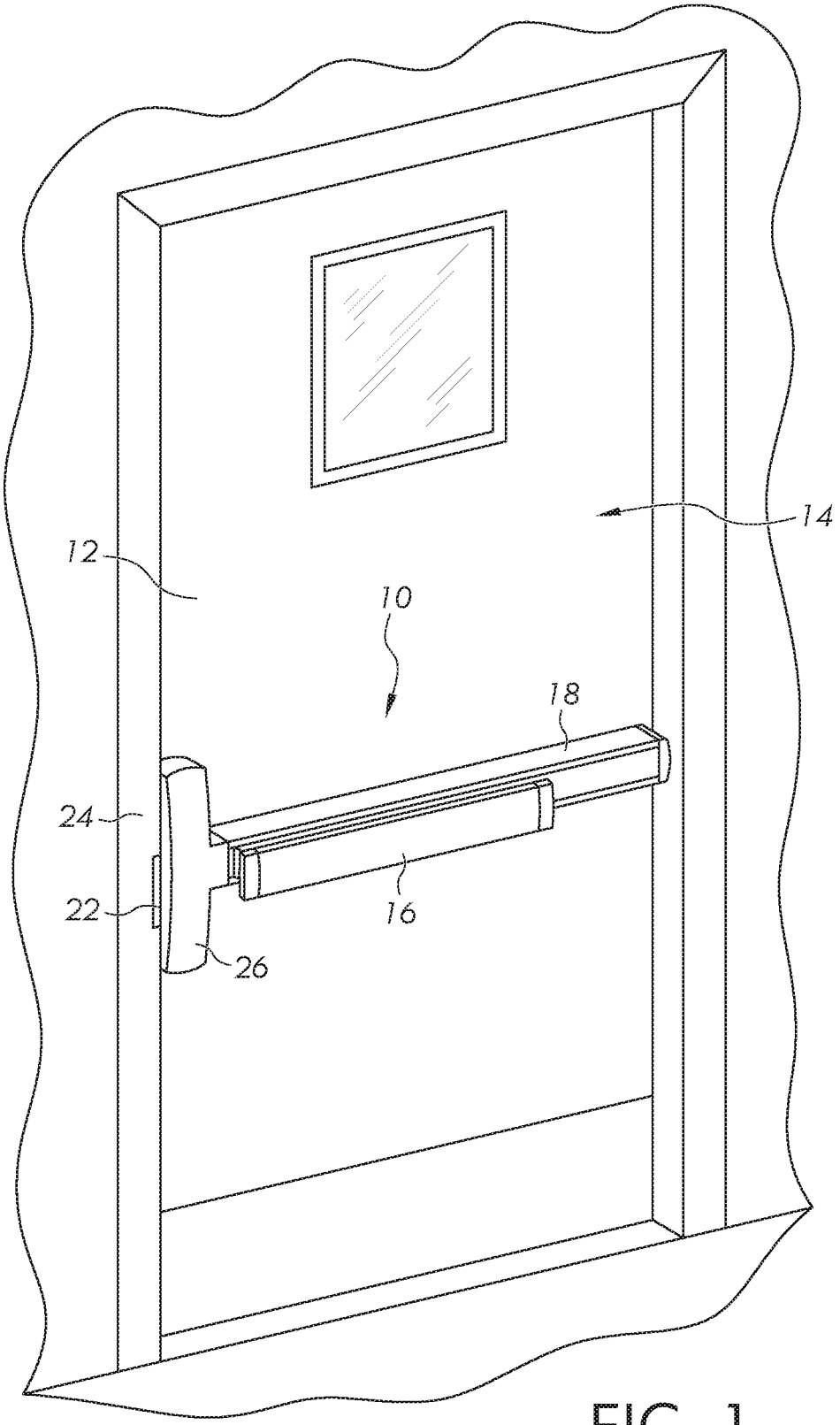
FIG. 1 illustrates a locking device according to one embodiment, as mounted on a door.

For the purposes of promoting an understanding of the principles of the invention, reference will now be made to the embodiments illustrated in the drawings and specific language will be used to describe the same. It will nevertheless be understood that no limitation on the scope of the invention is hereby intended. Any alterations and further modifications in the described embodiments, and any further applications of the principles of the invention as described herein are contemplated as would normally occur to one skilled in the art to which the invention relates.

FIG. 1 illustrates one embodiment of a locking device 10. The locking device 10 is mounted on an inside surface 12 of a door 14 and is configured for locking and unlocking the door 14. The door 14 can generally be utilized as an emergency exit or fire exit in a building or room. However, other types of doors and applications of the locking device 10 are also contemplated as falling within the scope of the invention. In one embodiment, the locking device 10 may be configured as an exit device that remains locked when a pushbar 16 is positioned in an extended or released position with respect to a housing 18 of the exit device, thereby preventing a person from accessing or opening the door 14 from the other side of the door 14 (i.e., the unsecure side). To unlock the door 14 from the inside 12 (i.e., the secure side), a user pushes, actuates, or moves the pushbar 16 to a depressed or contracted position with respect to the housing 18. Pressing the pushbar 16 actuates a locking mechanism (further described below) to unlock the door 14.

In the illustrated embodiment, a latchbolt 20 (FIG. 2) is operably connected to a locking mechanism of the exit device 10, and extends from the exit device 10 to lock and unlock the door 14. The door 14 is locked when the latchbolt 20 extends from the exit device 10 and is received within a receiving aperture or placed against a door strike 22 located at a door frame 24. The door 14 is unlocked by a user depressing the pushbar 16 toward the housing 18 and consequently toward the door 14. Pushing or depressing the pushbar 16 actuates the locking mechanism to retract the latchbolt 20, while at the same time supplying a force to move the door from the closed position to the open position. The locking mechanism is covered by a locking mechanism housing 26. In other embodiments, the door strike 22 includes a door strike plate having a cutout attached to the door frame and having a cavity located in the door frame and adapted to receive a latchbolt, a rod displaced from a door frame configured to engage a latchbolt, and a remote latching device.

Figure 2:
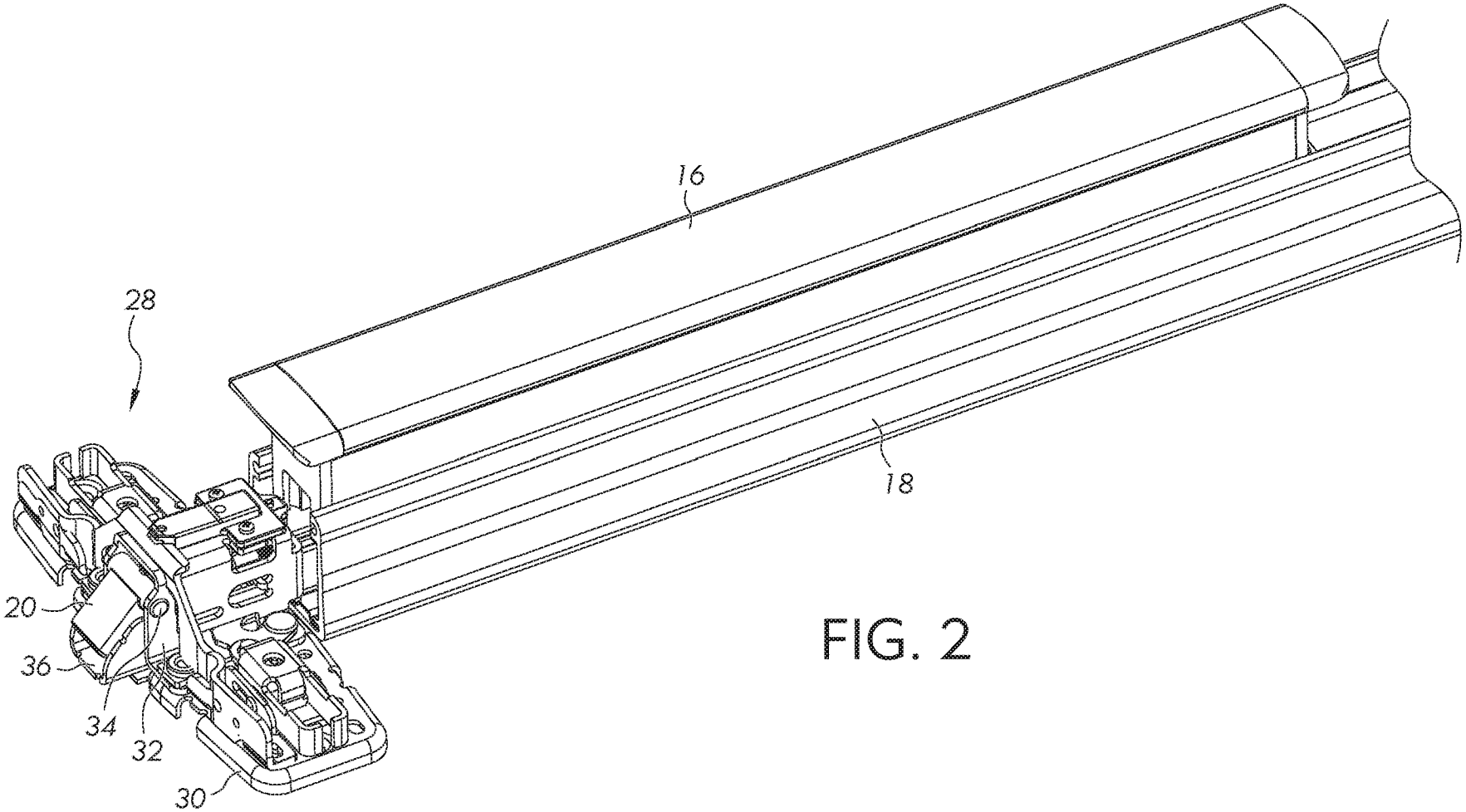
FIG. 2 illustrates the locking device of FIG. 1 with the latchbolt in an extended position.

FIG. 2 illustrates a perspective view of the locking device 10, or exit device, including the pushbar 16, the housing 18, and the latchbolt 20 which extends from a locking mechanism 28. For clarity, the locking mechanism housing 26 is not shown. The locking mechanism 28 includes a frame 30 adapted to be affixed to the door 14 at a location aligned with the strike 22 located on the door frame 24. A latchbolt mounting bracket 32 is coupled to the frame 30 and rotatably supports the latchbolt 20 at a pin 34 which extends through the bracket 32. Upon depressing of the pushbar 16 toward the frame 18, the latchbolt 20 is rotatably moved about the pin 34 in a direction toward the housing 18, and an auxiliary latchbolt 36 is slidingly retracted toward the housing 18. Depressing the pushbar 16 therefore moves both the latchbolt 20 and the auxiliary latchbolt 36 away from the door strike 22 to enable the door to be opened.

Figure 3:
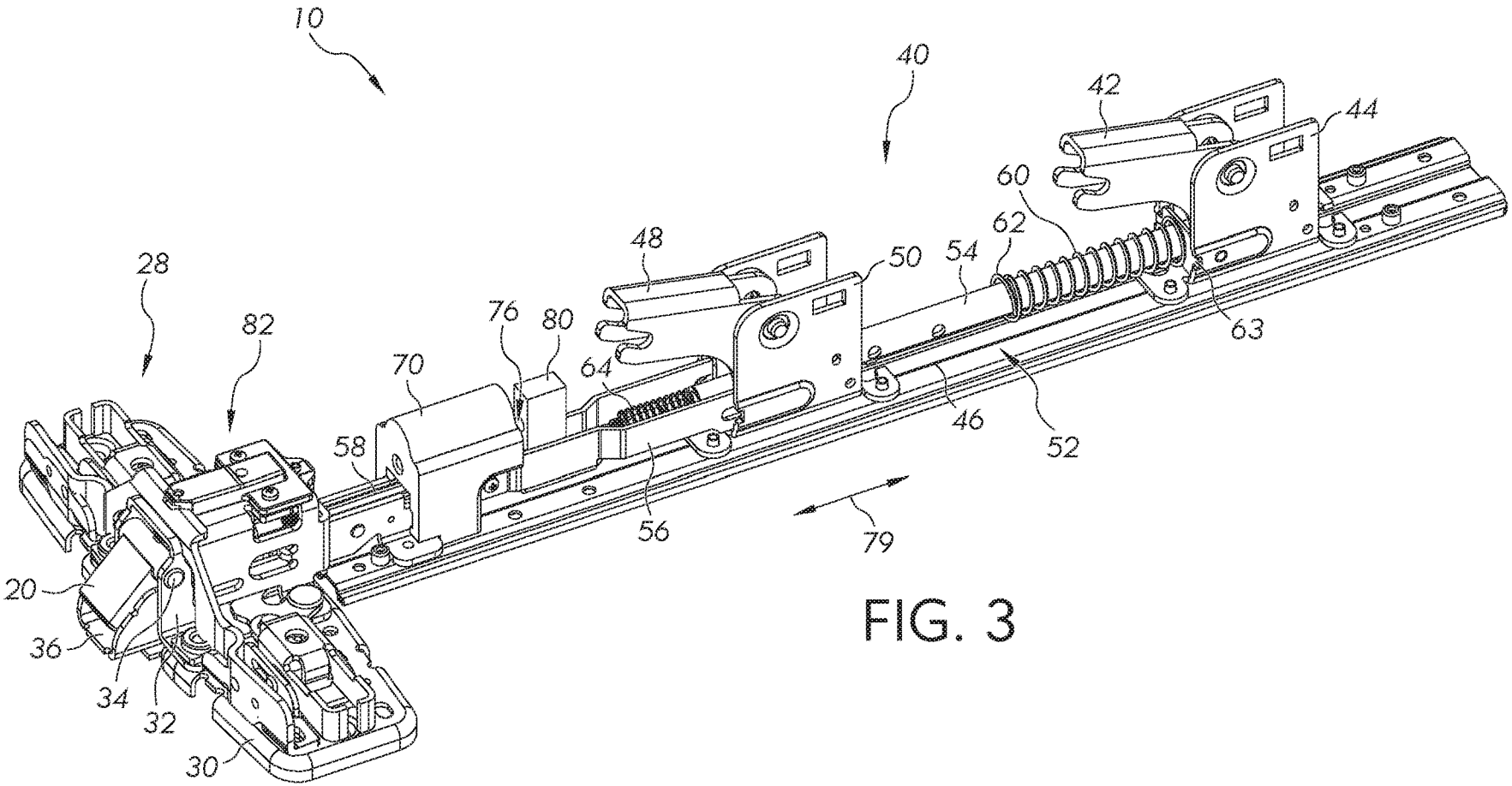
FIG. 3 illustrates the locking device of FIG. 2 with the pushbar and housing removed for clarity.

FIG. 3 illustrates a perspective view of the locking device 10 with the pushbar 16 and the housing 18 removed to show an actuating mechanism 40 which responds to movement of the pushbar 16 toward the housing 18 to actuate the latchbolt 20. The actuating mechanism 40 includes a first bell crank 42 rotatably coupled to a first mounting bracket 44 which is fixedly supported by a base plate 46. A second bell crank 48 is rotatably coupled to a second mounting bracket 50. A drive assembly 52 is operatively connected to the first bell crank 42, the second bell crank 48, and the latchbolt 20. Movement of the pushbar 16 moves each of the first and second bell cranks 42 and 48, which moves the drive assembly 52, which in turn retracts the latchbolt 20 and auxiliary latchbolt 36 from the illustrated position. Upon release of the pushbar 16, the pushbar 16 is returned to the position of FIG. 2 via the drive assembly 52, which is biased or spring loaded to the extended or released position.

The drive assembly 52 includes a drive bar 54 that moves longitudinally along the base plate 46 in both directions. The drive bar 54 is operatively connected to a split link 56, which is in turn operatively connected to a locking link 58. The drive bar 54 is located within a main spring 60 which has one end fixed in position by a collar 62 fixedly coupled to the drive bar 54. The other end of the main spring 60 is fixedly located at a second collar 63 which is positioned adjacent the bracket 44. A terminating end of the drive bar 54 is operatively connected to the split link 56 with a link spring 64.

Movement of the drive bar 54 is transmitted by the split link 56 and the locking link 58 to the latchbolt 20. Movement of the drive bar 54 in a rightward direction (as illustrated), also known as a retracting direction, causes the latchbolt 20 to retract toward an unlatching position. The main spring 60 is compressed between the collar 62 and the mounting bracket 44. The second collar 63 acts as an anchor such that the main spring 60 exerts a main spring biasing force on the collar 62 and toward the latchbolt 20 to maintain the latchbolt 20 in the extended position when the pushbar 16 is in the extended position. Depressing the pushbar 16 moves each of the bell cranks 42 and 48 toward the base plate 46, which moves the drive assembly 52, and in particular, the drive bar 54, in a direction to the right (as illustrated) to retract the latchbolt 20. At the same time, the main spring 62 and the link spring 64 are compressed, which increases the tension of each, which is then released once the pushbar 16 is released to return the latchbolt 20 to the extended position.

Figure 4:
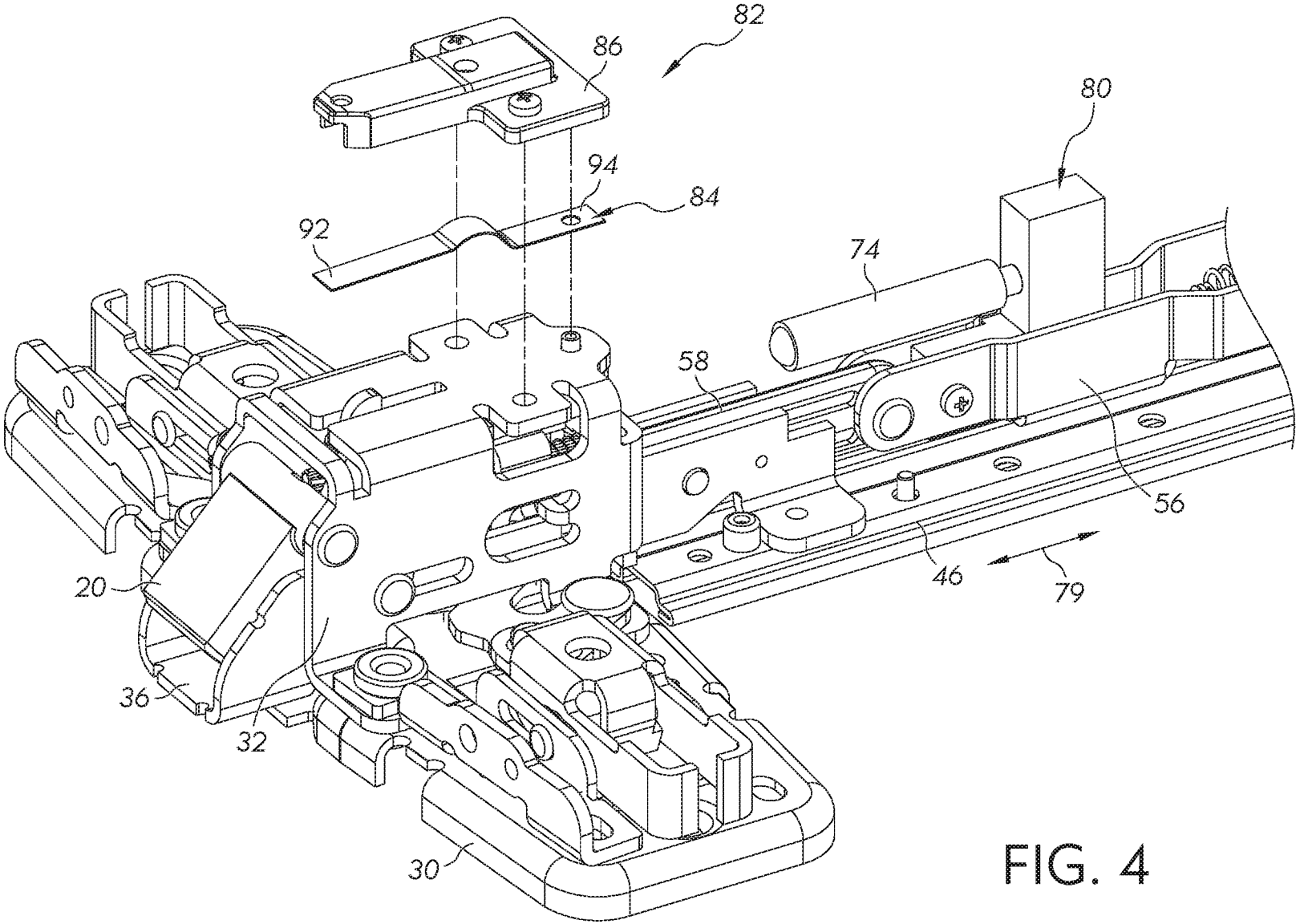
FIG. 4 illustrates a perspective view a latchbolt assembly including an exploded view of a portion of the dampening system.
Figure 5:
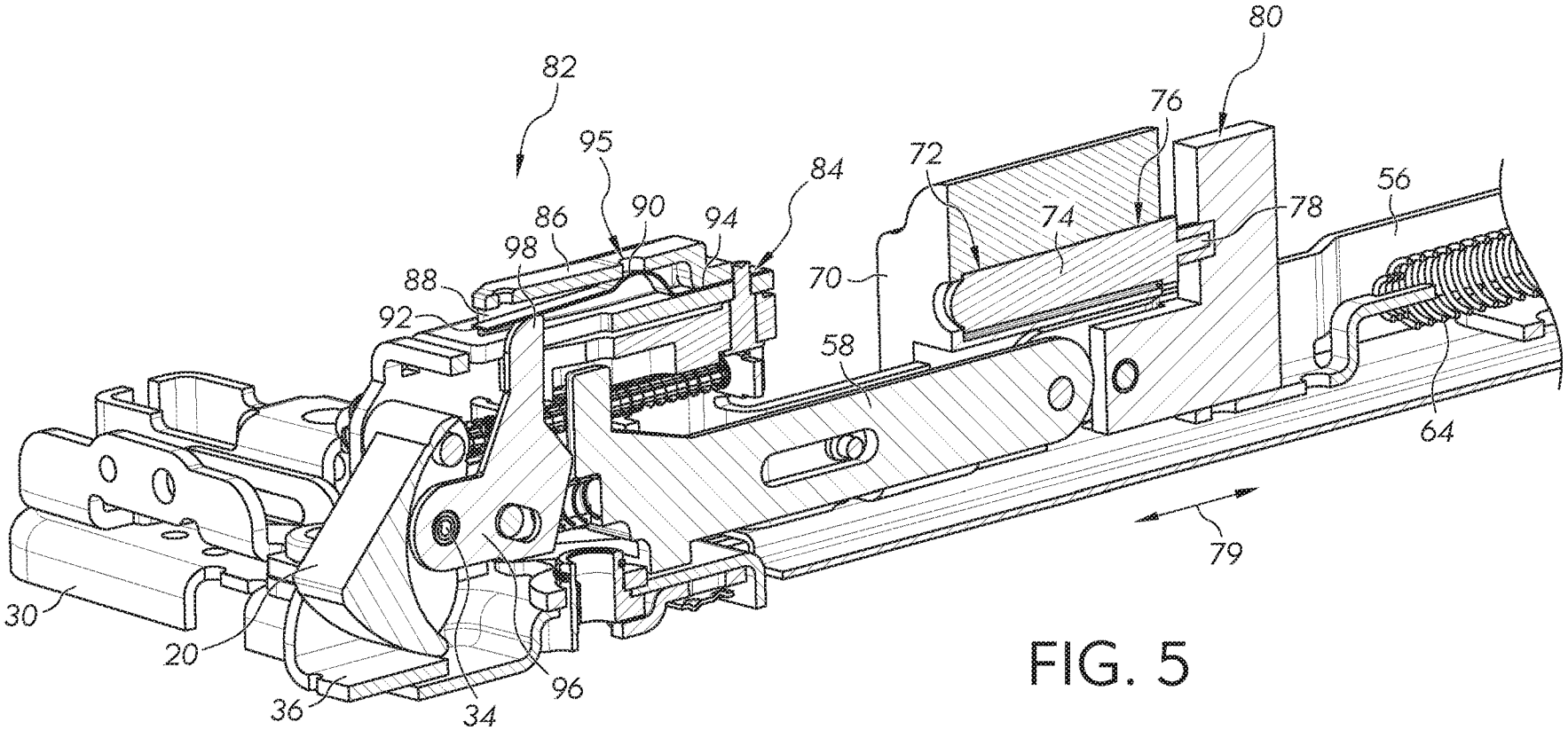
FIG. 5 illustrates a perspective sectional view of the latchbolt assembly of FIG. 4.

The exit device 10 further includes a dampening device having a damper housing 70 which is fixedly coupled to the base plate 46 at a location between the bell crank 48 and the latchbolt 20. The housing 70 includes an aperture 72 sized and configured to receive a body 74 of a damper 76 having rod 78 (FIGS. 4 and 5). The housing 70 is removed in FIG. 4. The rod 78 is operatively connected to a movable support 80 which is operatively connected to the split link 56. As the split link 56 moves longitudinally in a direction 79 along the base plate 46, the movable support 80 moves as well. An end of the rod 78 is fixedly coupled to the movable support 80. Retraction of the latchbolt 20, resulting from movement of the drive assembly 52 in the illustrated rightward direction, pulls the rod 78 away from the body 74 of the damper 76.

The dampening device further includes a bias arrangement 82 which includes a flexible contact member 84 that is fixedly coupled to the mounting bracket 32. The contact member 84 is resilient, and in one embodiment is cantilevered. The contact member 84 extends along the longitudinal direction of the base plate 46 and is covered by a cover 86, which is also fixedly coupled to the bracket 32. The cover 86 defines an interior region 88 having a space sufficient to enable the cantilever member 84 to flexibly move within the interior region 88. In one embodiment, the cantilever member 84 includes a leaf spring having a length longer than a width, and includes a bend 90 located between a free end 92 and a fixed end 94. The bend 90 is located at an aperture 95 which provides a recessed area on an underneath or bottom side of the cover 86 to locate the bend 90.

The free end 92 and a portion of the cantilever member 84, located between the bend 90 and the free end 92, is disposed adjacent to a latchbolt link 96 which is rotatably coupled to the pin 34. The latchbolt link 96 includes an extension or pawl 98 that extends from the pin 34 and contacts the cantilever member 84 as the latchbolt link 96 pivots. When the locking link 58 moves longitudinally in either direction 79, the pawl contacts the cantilever member 84. By contacting the cantilever member 84, noise resulting from movement of the latchbolt 20, the auxiliary latchbolt 36, the latchbolt link 96, and/or other related components is reduced or dampened. This reduction in noise results from these and other parts being substantially prevented from moving too quickly, or from sudden movement of parts contacting other parts, and more particularly metal-to-metal contact. In one embodiment, the pawl 98 contacts the cantilever member 84 continuously throughout the movement thereof. In another embodiment, the pawl 98 does not contact the cantilever member 84 throughout the entire range of travel. In other embodiments, a latchbolt assembly includes one, some, or all of the latchbolt 20, the auxiliary latchbolt 36, and the latchbolt link 96.

Figure 6:
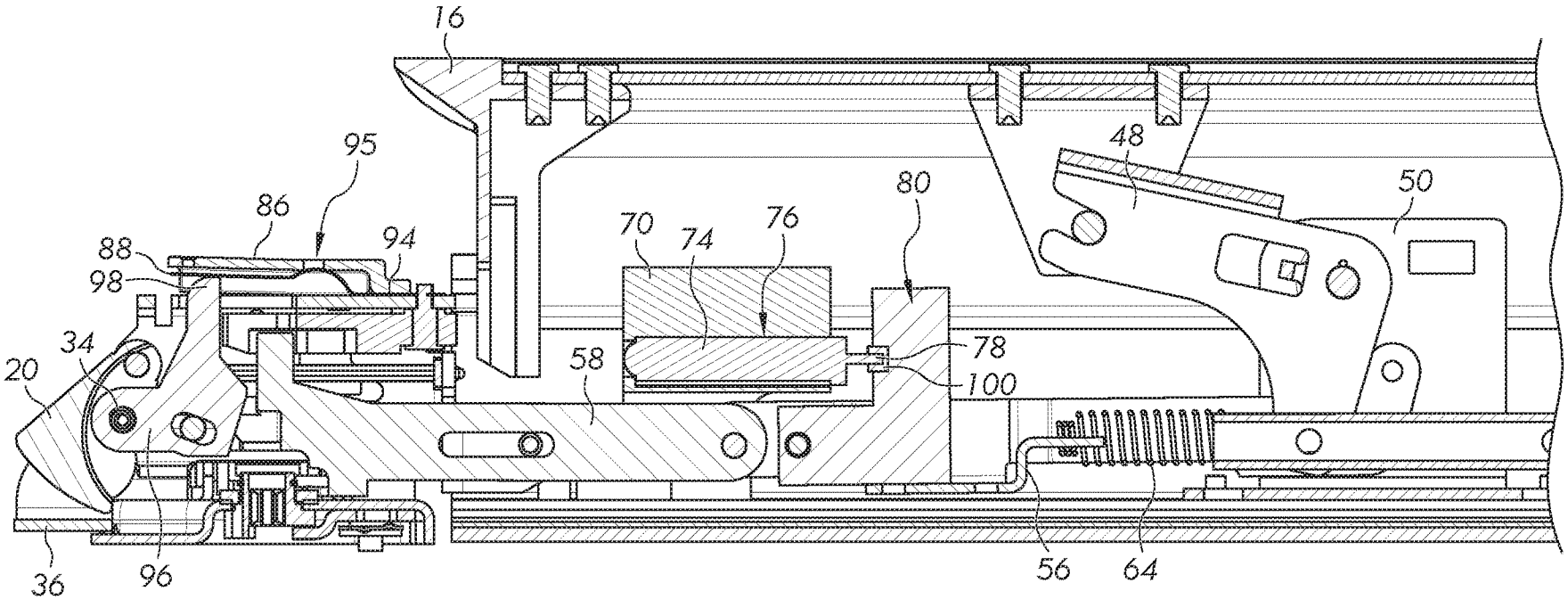
FIG. 6 illustrates an elevational sectional view of a portion of the locking device of FIG. 2 including a pushbar in an extended position.

FIG. 6 illustrates the pushbar 16 in the released position and the latchbolt 20 in the extended position. The rod 78 is fixedly coupled to the movable support 80 by a coupler 100 such that movement of the movable support 80 with respect to the fixed housing 70 moves the rod 78 with respect to the body 74 located in the fixed housing 70. In FIG. 6, the damper 76 is in a neutral position in which the rod 78 does not move unless displaced by an external force. In one embodiment, the damper 76 includes an internally located spring coupled to the rod 78, which is in a state of relaxation in the illustrated position. When the rod 78 is pulled from the body 74, the spring is placed in a state of tension, which in turn tends to pull the rod 78 back into the body 74. In another embodiment, the damper 76 is configured as a hydraulic damper.

Figure 7:
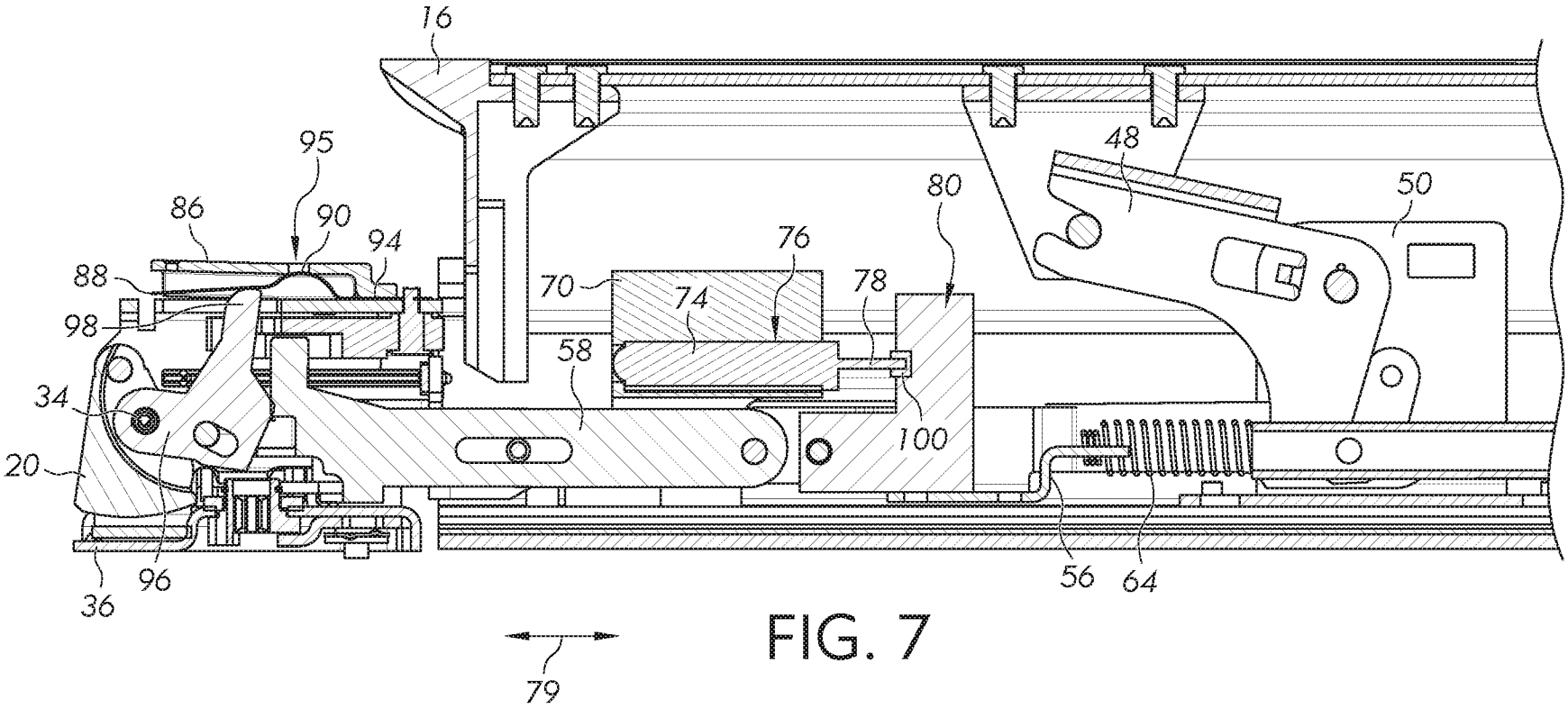
FIG. 7 illustrates an elevational sectional view of a portion of the locking device of FIG. 2 including a latch in the retracted position and the pushbar in a released position.

FIG. 7 illustrates the latchbolt in the retracted position. The latchbolt retracts and extends in two conditions: 1) when the pushbar 16 is pressed to retract the latch to open the door, and 2) when the door is closed after being open. FIG. 7 illustrates the exit device 10 when the latchbolt 20 contacts the door strike 22 as the door 14 is moving toward the closed position. The latchbolt 20 moves into the retracted position upon hitting the door strike 22 and extends outwardly after clearing the door strike. During closing of the door, the pushbar 16, as illustrated in FIG. 7, does not remain in the depressed position, but returns to the released position. When the pushbar 16 is depressed, the latchbolt 20 is retracted, but whenever the latchbolt 20 moves to a retracted position, the pushbar is not in the depressed position. Consequently, the dampening device engages the latchbolt assembly whenever the latchbolt 20 moves from the retracted position to the extended position.

The rod 78 is pulled away from the body 74 of the damper 76 to extend the internal spring to increase tension. The locking link 58 also moves to the right, which moves the pawl 98 to the right along the resilient member 84. Once the pushbar 16 is released, the locking link 58 moves to the left (as illustrated), the movement of which is buffered by the spring 64 and the damper 76 as the rod 78 retracts into the body 74. The retraction of the rod 78 provides dampening of the movement of the movable support 80 to slow down movement of the drive assembly 52, which could otherwise be present if there were no damper 76. By slowing down the entire assembly, noise is reduced as the latchbolt 20 and auxiliary latchbolt 36 move to the extended positions.

While the invention has been illustrated and described in detail in the drawings and foregoing description, the same is to be considered as illustrative and not restrictive in character, it being understood that only the preferred embodiments have been shown and described, and that all changes and modifications that come within the spirit of the inventions are desired to be protected. For instance, the present disclosure is not limited to pushbar type exit or locking devices, but other types of locking devices having a handle or other types of actuators are also contemplated. Actuators including both electrical and mechanical actuators to displace a latchbolt from an engaged position with a strikeplate to a disengaged position relative to the strikeplate are included. The other types of locks include, but are not limited to, mortise locks, cylindrical locks, tubular locks, and remote latching devices used with single or multiple exit doors and devices.

One feature of each of the locking devices includes an actuator which moves from a neutral position to a displaced position to lock and unlock the device. Typically, the actuator remains in the neutral position until moved to the displaced position by an external force. In the case of the pushbar device, the neutral position is the released position of the pushbar, and the displaced position is the depressed position of the pushbar. In the case of a cylindrical lock having a handle or knob, rotation of the knob about a rotational axis moves the knob from the neutral position to the displaced position. Each of these locking devices includes moving mechanical components, and the noise generated by movement of the mechanical components being reduced when configured to include the disclosed embodiments and other modifications as set forth in the present disclosure.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A locking device for a door located at a door frame having a door strike, comprising:

a latchbolt assembly including an extended position configured to engage the door strike and a retracted position configured to move past the door strike;

an actuator adapted to move the latchbolt assembly from the extended position to the retracted position; and a dampening device disposed adjacent to the latchbolt assembly, wherein the dampening device resiliently engages the latchbolt assembly as the latchbolt assembly moves from the retracted position to the extended position;

wherein the latchbolt assembly includes a latchbolt and a latchbolt link pivotally connected to the latchbolt, wherein the latchbolt link pivots from a first position to a second position as the latchbolt moves from the retracted position to the extended position, wherein the dampening device is engaged with the latchbolt link to dampen movement of the latch, and wherein the dampening device comprises a cantilever member extending toward the latchbolt link.

2. The locking device of claim 1, wherein the locking device is an exit device and the actuator is a pushbar, and wherein the latchbolt link moves from the first position to the second position when the pushbar moves from a depressed position to an extended position.

3. A locking device for a door located at a door frame having a door strike, comprising:

a latchbolt assembly including an extended position configured to engage the door strike and a retracted position configured to move past the door strike;

an actuator adapted to move the latchbolt assembly from the extended position to the retracted position; and a dampening device disposed adjacent to the latchbolt assembly, wherein the dampening device resiliently engages the latchbolt assembly as the latchbolt assembly moves from the retracted position to the extended position;

wherein the locking device comprises an exit device and the actuator comprises a pushbar, wherein the latchbolt assembly includes a latchbolt and a latchbolt link operatively connected to the latchbolt and to the pushbar, wherein the latchbolt link moves from a first position to a second position when the pushbar moves from a depressed position to an extended position, and wherein the dampening device resiliently engages the latchbolt link; and wherein the dampening device includes a cantilever member extending toward the latchbolt link.

4. The locking device of claim 3, wherein the cantilever member contacts the latchbolt link continuously during movement of the pushbar from the extended position to the depressed position and back to the extended position.

5. The locking device of claim 1, wherein the dampening device comprises a leaf spring.

6. The locking device of claim 1, wherein the locking device includes one of a pushbar locking device, a mortise lock, a cylindrical lock and a tubular lock.

7. The locking device of claim 1, wherein the latchbolt link is operatively connected to the actuator, and wherein the latchbolt link pivots from the first position to the second position when the actuator moves from a neutral position to a displaced position.

8. A locking device for a door located at a door frame having a door strike, comprising:

a latchbolt assembly including an extended position configured to engage the door strike and a retracted position configured to move past the door strike;

an actuator adapted to move the latchbolt assembly from the extended position to the retracted position; and a dampening device disposed adjacent to the latchbolt assembly, wherein the dampening device resiliently engages the latchbolt assembly as the latchbolt assembly moves from the retracted position to the extended position;

wherein the latchbolt assembly includes a latchbolt and a latchbolt link operatively connected to the latchbolt and to the actuator, wherein the latchbolt link moves from a first position to a second position when the actuator moves from a neutral position to a displaced position, and wherein the dampening device resiliently engages the latchbolt link; and wherein the dampening device includes a cantilever member extending toward the latchbolt link.

9. The locking device of claim 8, wherein the cantilever member includes a leaf spring resiliently biased toward the latchbolt link.

10. The locking device of claim 8, wherein the cantilever member contacts the latchbolt link continuously during movement of the latchbolt link.

11. The locking device of claim 1, wherein the locking device is an exit device and the actuator is a pushbar; and wherein the latchbolt is positioned in the retracted position when the pushbar is in a depressed position; and wherein the latchbolt is positioned in the extended position when the pushbar is in an extended position.

12. The locking device of claim 1, wherein the locking device is an exit device and the actuator is a pushbar; and wherein the latchbolt is positioned in the extended position when the pushbar is in an extended position.

13. The locking device of claim 12, wherein the dampening device dampens movement of the latchbolt as the latchbolt moves from the retracted position to the extended position.

14. The locking device of claim 1, wherein the locking device is an exit device and the actuator is a pushbar; and wherein the latchbolt is displaced between the extended position and the retracted position when the pushbar is depressed or released.

15. The locking device of claim 14, wherein the dampening device dampens movement of the latchbolt as the latchbolt moves from the retracted position to the extended position.

16. The locking device of claim 1, wherein the dampening device dampens movement of the latchbolt from the retracted position to the extended position.

17. A locking device for a door located at a door frame having a door strike, comprising:

a latchbolt assembly including an extended position configured to engage the door strike and a retracted position configured to move past the door strike;

an actuator adapted to move the latchbolt assembly from the extended position to the retracted position; and a dampening device disposed adjacent to the latchbolt assembly, wherein the dampening device resiliently engages the latchbolt assembly as the latchbolt assembly moves from the retracted position to the extended position;

wherein the latchbolt assembly includes a latchbolt and a latchbolt link pivotally connected to the latchbolt, wherein the latchbolt link pivots from a first position to a second position as the latchbolt moves from the retracted position to the extended position, wherein the dampening device is engaged with the latchbolt link to dampen movement of the latch, and wherein the dampening device directly contacts the latchbolt link.

18. The locking device of claim 1, wherein the dampening device comprises a leaf spring.

19. The locking device of claim 17, wherein the dampening device comprises a cantilever member extending toward the latchbolt link.

20. The locking device of claim 17, wherein the dampening device directly contacts the latchbolt link continuously during the movement of the latch from the retracted position to the extended position.

21. The locking device of claim 3, wherein the cantilever member includes a leaf spring resiliently biased toward the latchbolt link.

* * * * *